United States Patent [19]

Klink et al.

[11] 4,167,252

[45] Sep. 11, 1979

[54] STRAND COLLECTING APPARATUS AND METHOD

[75] Inventors: Jerome P. Klink; Arnold J. Eisenberg, both of Granville, Ohio

[73] Assignee: Owens-Corning Fiberglas Corporation, Toledo, Ohio

[21] Appl. No.: 901,546

[22] Filed: May 1, 1978

Related U.S. Application Data

[63] Continuation of Ser. No. 724,825, Sep. 20, 1976, abandoned.

[51] Int. Cl.[2] ..... B65H 54/02

[52] U.S. Cl. ..... 242/18 G; 242/18 R; 242/42; 242/43 R

[58] Field of Search ..... 242/18 G, 18 R, 43 R, 242/158 R–158.5, 42

[56] References Cited

U.S. PATENT DOCUMENTS

| | | | |
|---|---|---|---|
| 3,041,664 | 7/1962 | Green | 242/18 G |
| 3,802,636 | 4/1974 | Ogawa | 242/43 R X |
| 3,901,455 | 8/1975 | Carlisle | 242/18 G |
| 3,981,458 | 9/1976 | Rogers | 242/43 R |

*Primary Examiner*—Stanley N. Gilreath

*Attorney, Agent, or Firm*—Ronald C. Hudgens; Philip R. Cloutier; Ted C. Gillespie

[57] ABSTRACT

A strand collecting apparatus and method of the type in which the strand is split into bundles and advanced by, and wound onto, a rotating collet is disclosed. The strand is traversed linearly of the axis of rotation of the collet by the rotation of a rotating strand traverse. The strand traverse is oscillated in a direction parallel to the axis of rotation of the collet, and a strand splitter oscillates in phase with the strand traverse to guide the strand into engagement with the strand traverse.

8 Claims, 4 Drawing Figures

STRAND COLLECTING APPARATUS AND METHOD

This application is a continuation of our copending application Ser. No. 724,825, filed Sept. 20, 1976, now abandoned.

The present invention relates to the collecting of strands of material. More particularly this invention relates to the winding of strands on a rotating drum to form a package. The strands can consist of glass fibers, or can be comprised of fibers of other materials such as other mineral materials or synthetic resin materials.

In strand collecting operations widespread use of rotating drums, or collets, is made in order to wind the strand into packages. It has been found advantageous to traverse the strand, with a strand traverse, longitudinally of the axis of the collet in a helical pattern on the collet rather than in a circular pattern. Such a helical winding pattern prevents adjacent loops or wraps of strand from fusing together should the strand be still wet from the application of a protective size material. The spiral wire traverse shown in U.S. Pat. No. 2,391,870 to Beach has proven to be a very effective strand traverse apparatus for traversing the strand at the high rates of speed necessary for efficient collecting of strand.

In certain winding operations it is desirable to split the strand into a plurality of bundles of fibers, and to maintain the split condition as the strand is collected into the package in order to prevent any fiber bundle from fusing to another fiber bundle. A package of such split strand would then be suitable for supplying strand which consists of a plurality of bundles which are not fused to each other. Such a package of split strand could be useful in a chopped strand operation requiring a specific bundle diameter or fiber count smaller than the diameter or fiber count of a full strand.

Strands are commonly separated into bundles in a split strand winding operation by the use of a comb-like strand splitter which maintains the separation of the various bundles by providing a separate guide path for each bundle. In some split strand operations, two or more splitters are used to separate a traveling strand into bundles. For example, in a 200-fiber strand, two five-position strand splitters can be utilized to divide the strand into ten bundles of approximately twenty fibers each. The strand is usually split into bundles by a manual placement of groups of fibers into the separate guide paths on the strand splitter. The distance from the strand splitter to the strand traverse during winding is determined by such factors as the speed of the traverse of the strand, the design of the spiral wire on the strand traverse, and the number of bundles into which the strand is split.

Developments in the art of collecting strand have resulted in the use of a strand traverse which oscillates in a direction parallel to the axis of rotation of the collet. This oscillation permits the collection of the strand into a longer and larger package. A typical strand traverse can be operated with a 10-second period of oscillation.

Further developments in the art of collecting strand have resulted in the use of a strand guide means which oscillates in phase with the strand traverse to guide the strand into engagement with the strand traverse. In a split strand winding operation the strand guide means can be a strand splitter. Other forms of strand guide means can be used. For example, a funnel shaped guide member can be used.

U.S. Pat. No. 3,901,455 to Carlisle discloses a strand collecting operation utilizing a strand guide means which is a strand splitter oscillating in phase with a strand traverse. The strand collecting operation of Carlisle does not provide for the strand guide means to travel in a straight line, but rather to travel in an arc. The strand guide means of Carlisle thus does not maintain a constant spacing from the oscillating strand traverse which is oscillating in a straight line.

U.S. Pat. No. 3,041,664 issued to Green discloses a strand collecting apparatus in which a strand guide means is oscillated in phase with a strand traverse in order to gather fibers into a strand. The strand collecting apparatus of Green does not utilize a strand guide means which is a strand splitter, however, as is required to produce a split strand package. The strand collecting operation of Green also fails to supply a means for causing the strand guide means to move away from the collet for a more efficient engagement of the strand with the strand guide means.

In strand collecting operations in which an oscillating strand guide means is used to guide the split strand into engagement with an oscillating strand traverse, the apparatus is usually arranged so that the path of the strand changes direction at the strand traverse, i.e., the strand guide means, the strand traverse and the point of strand collection on the package are non-collinear. Thus, the strand path forms an obtuse angle at the strand traverse. This angle in the strand path at the strand traverse is desirable to insure contact between the strand and the strand traverse sufficient for proper traverse of the strand.

It is important, however, that the contact between the strand and the strand traverse create neither a drag force too great, nor a drag force which varies uncontrollably. Irregularities in strand tension can result in snarling or "birdnesting" of strand during run-out or removal from the package.

Heretofore, packaging operations of strands utilizing a strand guide means oscillating in phase with a strand traverse have experienced problems of varying strand tension during the packaging process. As the strand is wound on the package and the diametral size of the package increases, the angle of the strand path at the strand traverse changes. This changed strand path angle gives changed angular wrap of the strand on the strand traverse, and hence a changed drag force. Varying drag forces result in varying strand tension during packaging and consequent run-out problems.

It has been found that by controlling the position of the strand guide means relative to the position of the strand traverse, the angle of the strand path at the strand traverse can be controlled, and thus the tension of the strand as it is packaged can be controlled.

Accordingly there is provided an improved method and apparatus for collecting strand on a rotating collet.

There is also provided an improved strand collecting method and apparatus of the type in which the strand is advanced by, and wound onto, a rotating collet, the strand is traversed linearly of the axis of the collet by the rotation of a rotating strand traverse, the strand traverse is oscillated in a direction parallel to the axis of rotation of the collet, a strand guide means oscillates in phase with the strand traverse, to guide the strand into engagement with the strand traverse, and the strand guide means, the strand traverse, and the point of collection of the strand on the package are non-collinear so that the path of the strand defines an angle at the strand traverse and the angle has a component angle in a plane perpendicular to the axis of revolution of the collet, and the strand guide means is moved in order to control the component angle of the strand path at the strand traverse during packaging. The strand guide means can be moved in such a pattern as to maintain the component angle of the strand path at a constant. The strand guide means can be a strand splitter.

This invention will be more fully understood by reference to the following drawings.

The following description of the preferred embodiment in terms of a glass fiber forming and collecting operation in which strands of fibers are divided into a plurality of bundles of fibers is offered for purposes of illustration of the principles of this invention, and it is not intended to be limiting.

Figure 1:
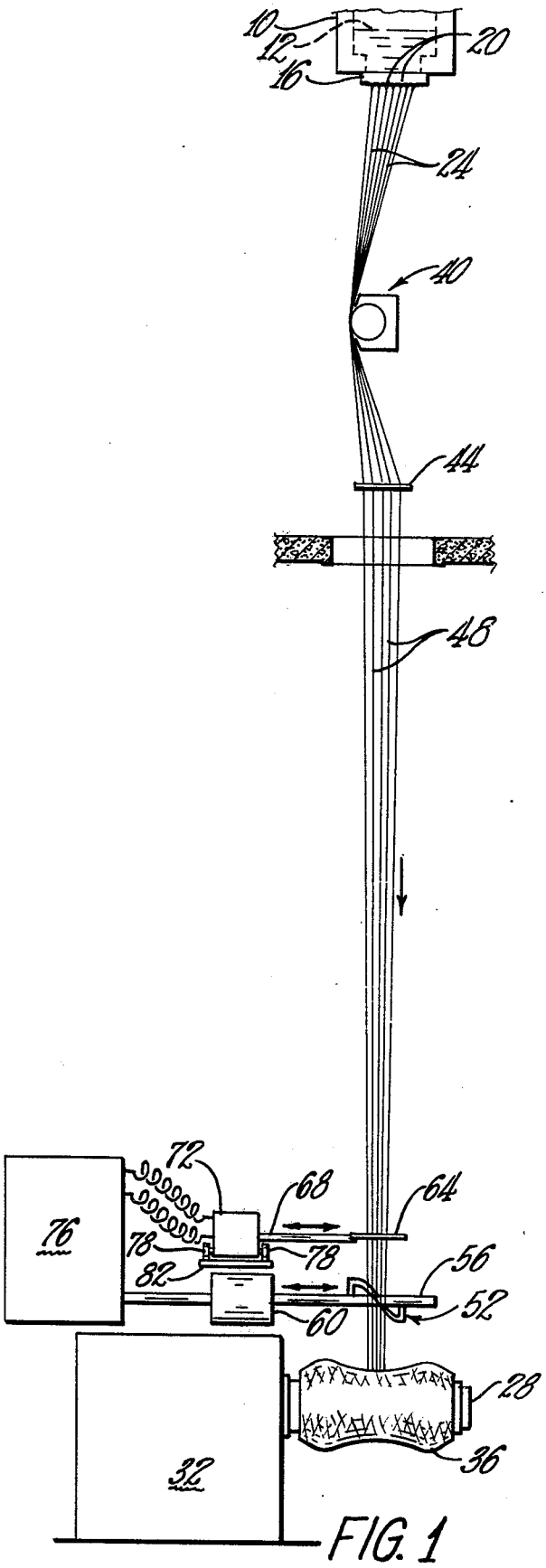
FIG. 1 is a diagramatic front view of apparatus according to the principles of this invention.

In FIG. 1 there is shown a glass melter or forehearth 10 containing supply of molten glass 12. The melter bottom wall is comprised of bushing 16 having a plurality of orifices 20 through which streams of glass emerge to form a strand of fibers 24. Any number of orifices can be present in the bushing. Prior to being wound on the collet, the fibers in the strand can be contacted by size applicator 40 which imparts a protective size.

The strand is pulled from the bushing and wound on rotating collet 28 which can be rotated by drive motor 32. As the strand is wound onto the collet, a package 36 is formed. The strand can be divided by primary strand splitter 44 into bundles 48. As will be shown, the strand remains split into bundles substantially throughout the remainder of the collection process.

Prior to reaching the collet, the split strand is traversed with strand traverse 52 which oscillates the strand longitudinally of the axis of the collet to create a helical winding pattern on the package. The strand traverse is rotated on strand traverse shaft 56 by motor 60. Motor 60 also imparts a horizontal oscillation motion to the strand traverse as shown by the horizontal arrow in FIG. 1. The strand traverse oscillates along a line parallel to the axis of rotation of the collet. This strand traverse oscillation permits the formation of longer and larger packages of strand on the collet.

Figure 2:
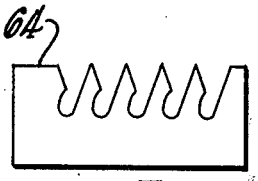
FIG. 2 is a plan view of the strand splitter according to the principles of this invention.

Secondary strand splitter 64 is positioned adjacent the strand traverse so that the strand traverse is between the collet and the secondary strand splitter to serve as an additional strand separation and guiding means. The secondary strand splitter maintains the separation of the bundles necessary for collection on the collet in a split condition. The shape of the preferred embodiment of the secondary strand splitter is illustrated in FIG. 2. It is to be understood that other designs of strand splitters are within the scope of this invention.

The secondary strand splitter is mounted on shaft 68 for oscillation along a line parallel to the line of oscillation of the strand traverse as shown in FIG. 1. Dual purpose motor 72 provides the oscillatory motive force for the secondary strand splitter and shaft. Controller 76 provides identical signals to motors 60 and 72 to insure that the oscillation of the strand traverse is in phase with the oscillation of the secondary strand splitter.

The secondary strand splitter and dual purpose motor 72 are mounted on rollers 78 for movement along travel track 82. Upon the appropriate signals from the controller, the dual purpose motor engages the rollers and drives itself and the secondary strand splitter along the track.

The motor can be adapted to drive a cam (not shown) which in turn reciprocates the secondary strand splitter. The dual purpose motor can be adapted with a clutch (not shown) to engage the rollers with the dual purpose motor upon the appropriate signal from the controller. The controller can be adapted with a timer and can be programmed to send signals to the clutch according to a predetermined timing sequence which corresponds to the diametral package build-up. The engagement of the clutch will drive the rollers and the secondary strand splitter, and therefore change the angle "alpha".

Figure 3:
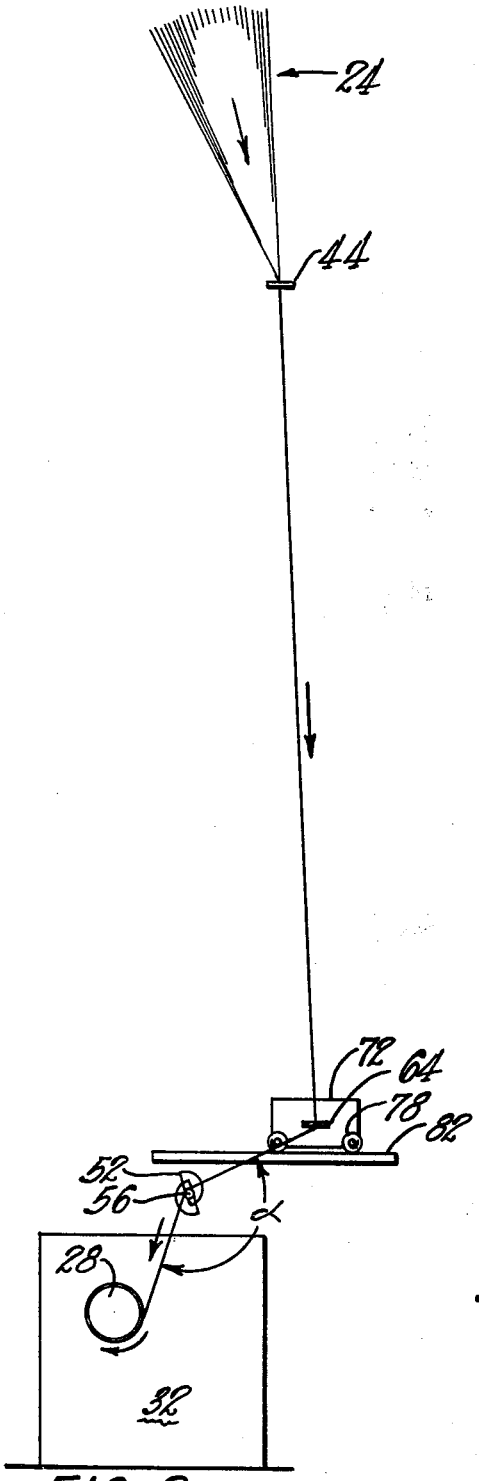
FIG. 3 is a diagramatic side view of apparatus according to this invention at the initiation of the strand collecting operation.
Figure 4:
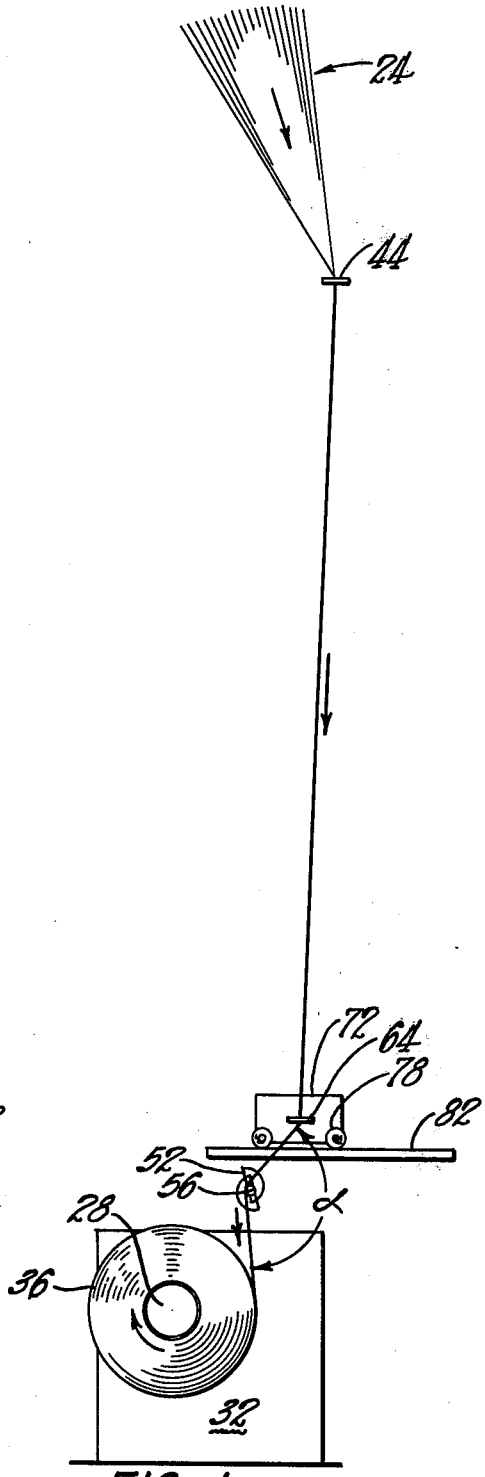
FIG. 4 is a diagramatic side view of apparatus according to this invention near the conclusion of the strand collecting operation.

As shown in FIGS. 3 and 4 the secondary strand splitter, the strand traverse and the point of collection of the strand on the package are non-collinear so that the strand path makes an angle alpha at the strand traverse. The angle "alpha" is the obtuse component angle, in a plane perpendicular to the axis of rotation of the collet, of the angle defined by the path of the strand from the strand guide means to the strand traverse to the package, as shown in FIGS. 3 and 4. Without movement of either the strand traverse or the secondary strand during packaging the angle alpha becomes smaller as the diametral size of the package increases. This change in the angle alpha increases the angular wrap of the strand on the strand traverse and changes the tension on the strand as it is laid on the package. By controlling the position of the dual purpose motor, and hence the secondary strand splitter, the angle alpha is controlled. Thus, a means is provided for continually controlling the tension of the strand as it is laid on the package.

The controller can be programmed to provide movement by the dual purpose motor and secondary strand splitter sufficient to maintain the angle alpha at a constant. The controller can be programmed, however, to provide numerous values of the size of the angle alpha during packaging.

While the apparatus and method of this invention have been described in terms of a strand guide means which is a strand splitter, it is to be understood that other variations of strand guide means can be utilized according to the principles of this invention.

Various modifications of the above described embodiments of the invention will be apparent to those skilled in the art, and it is to be understood that such modifications can be made without departing from the scope of the invention.

We claim:

1. Apparatus for winding strand as a package onto a rotatable collet comprising:

a strand traverse adapted to guide said strand onto said collet;

a strand guide means adapted to guide said strand onto said strand traverse, said strand being guided along a first path from said strand guide means to said strand traverse and a second path from said strand traverse to said package, an angle being formed therebetween at said strand traverse, said angle having an obtuse component angle lying in a plane perpendicular to the axis of rotation of said rotatable collet; and, means for moving said strand guide means during winding to control said obtuse component angle as the diametral size of said package increases.

2. The apparatus of claim 1 in which said strand guide means is a strand splitter.

3. The apparatus of claim 1 in which said strand guide means and said strand traverse are adapted to oscillate longitudinally of the axis of the rotation of said collet.

4. The apparatus of claim 1 in which said means for moving is adapted to maintain said obtuse component angle constant.

5. The method of winding strand as a package onto a rotatable collet comprising:

guiding said strand onto said collet with a strand traverse;

guiding said strand onto said strand traverse with a strand guide means, said strand being guided along a first path from said strand guide means to said strand traverse and a second path from said strand traverse to said package to form an angle therebetween at said strand traverse, said angle having an obtuse component angle lying in a plane perpendicular to the axis of rotation of said rotatable collet; and, moving said strand guide means during winding to control said obtuse component angle of said strand as the diametral size of said package increases.

6. The method of claim 5 in which said strand guide means is a strand splitter.

7. The method of claim 5 in which said obtuse component angle is maintained constant.

8. The method of claim 5 in which said strand traverse and said strand guide means are oscillated longitudinally of the axis of rotation of said collet.

* * * * *